US006497126B2

(12) United States Patent
Wang

(10) Patent No.: US 6,497,126 B2
(45) Date of Patent: Dec. 24, 2002

(54) OUTER HANDLE STRUCTURE OF A LOCK WHICH MAY BE IDLE

(75) Inventor: Jo Chiao Wang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 10 days.

(21) Appl. No.: 09/776,902

(22) Filed: Feb. 6, 2001

(65) Prior Publication Data

US 2002/0104345 A1 Aug. 8, 2002

(51) Int. Cl.[7] ..... E05B 13/10
(52) U.S. Cl. ..... 70/472; 70/224
(58) Field of Search ..... 70/472, 422, 221, 70/222, 223, 224

(56) References Cited

U.S. PATENT DOCUMENTS 4,920,773 A * 5/1990 Surko, Jr. ..... 70/224
5,040,391 A * 8/1991 Lin ..... 70/277
5,809,815 A * 9/1998 Lee ..... 70/472
6,038,894 A * 3/2000 Hu ..... 70/224
6,041,630 A * 3/2000 Shen ..... 70/472
6,085,561 A * 7/2000 Yao ..... 70/472
6,101,856 A * 8/2000 Pelletier et al. ..... 70/472
6,223,567 B1 * 5/2001 Fadul ..... 70/149
6,279,360 B1 * 8/2001 Shen ..... 70/224
6,357,270 B1 * 3/2002 Vasquez ..... 70/472
2001/0023600 A1 * 9/2001 Pompeii ..... 70/224

* cited by examiner

*Primary Examiner*—Robert J. Sandy
*Assistant Examiner*—Ruth C. Rodriguez
(74) *Attorney, Agent, or Firm*—Bacon & Thomas, PLLC

(57) ABSTRACT

An outer handle structure of a lock that may be idle includes an inner handle set provided with an inner handle for driving an inner drive shaft to rotate. The inner drive shaft drives a retractor to operate. The inner handle set is additionally provided with a press button that may be pressed to drive a safety bar to push a limit plate and a lock snap plate. A outer handle set is provided with an outer handle for driving an outer drive shaft to rotate. The outer drive shaft defines an annular slot and a straight slot arranged in a T-shape. A latch release set is provided with a retractor for drawing a lock tongue of a lock latch to operate, and has two ends respectively pivoted with the inner drive shaft of the inner handle set and the outer drive shaft of the outer handle set.

2 Claims, 7 Drawing Sheets

OUTER HANDLE STRUCTURE OF A LOCK WHICH MAY BE IDLE

BACKGROUND OF THE INVENTION

1. Field of the Invention

The present invention relates to an outer handle structure of a lock which may be idle.

2. Description of the Related Prior Art

The closest prior art of which the applicant is aware is disclosed in the Taiwanese Patent Publication No. 298249, entitled by "Flat Handle Lock Structure" which includes an inner handle set and an outer handle set which are respectively combined on the inner side and outer side of the door, to drive the inner drive shaft and the outer drive shaft to rotate, so that the retractor of the control set may draw the lock tongue to retract inward, thereby opening the door. The outer drive shaft places the control set therein, so that when the safety bar is locked, the press on the outer handle will form an idle rotation. The control set includes a shaft barrel 41, an elastic member 42, an inner fixing shaft 43, a movable piece 44, etc. Therefore, the lock includes a complicated construction, thereby causing inconvenience in assembly.

Another prior art of which the applicant is aware is disclosed in the Taiwanese Patent Publication No. 386557, entitled by "Outer Shank Structure of a Lock which may be Idle" which includes an inner handle set having an inner shank for driving an inner drive shaft to rotate, to press a press button, to push a follower plate by a safety bar, so that the follower block of the follower plate enters the wider slot of the bottom of the triangular slot of the outer drive shaft, or is pushed by the elastic member to return to be locked in the straight slot. The outer drive shaft may be driven by the outer shank, whereby by movement of the follower plate, the outer shank will perform an idle rotation, or may drive the retractor to operate, thereby opening the door.

SUMMARY OF THE INVENTION

The primary objective of the present invention is to provide a an outer handle structure of a lock which may be idle, wherein when the lock is locked, if the outer handle is pressed, it can only perform an idle rotation, and cannot drive the retractor to operate, thereby preventing illegally opening the lock and breaking the lock by strongly pressing the outer handle.

In accordance with the present invention, there is provided a outer handle structure of a lock that may be idle includes an inner handle set provided with an inner handle for driving an inner drive shaft to rotate. The inner drive shaft drives a retractor to operate. The inner handle set is additionally provided with a press button that may be pressed to drive a safety bar to push a limit plate and a lock snap plate. A outer handle set is provided with an outer handle for driving an outer drive shaft to rotate. The outer drive shaft defines an annular slot and a straight slot arranged in a T-shape. A latch release set is provided with a retractor for drawing a lock tongue of a lock latch to operate, and has two ends respectively pivoted with the inner drive shaft of the inner handle set and the outer drive shaft of the outer handle set. The outer drive shaft receives an inner shaft barrel and a lock snap disk therein. The inner shaft barrel receives an elastic member, a follower plate, and a lock snap plate therein which are prevented from being detached from the inner shaft barrel by the limit plate. The follower plate is provided with a follower block which protrudes outward from a straight slot defined in the inner shaft barrel, and may be locked in the annular slot or the straight slot of the outer drive shaft. The follower plate defines two depressions for allowing passage of two locking legs of the lock snap plate. The two locking legs of the lock snap plate may be locked in or detached from two locking holes of the lock snap disk. The inner shaft barrel has wing plates that may press the retractor.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
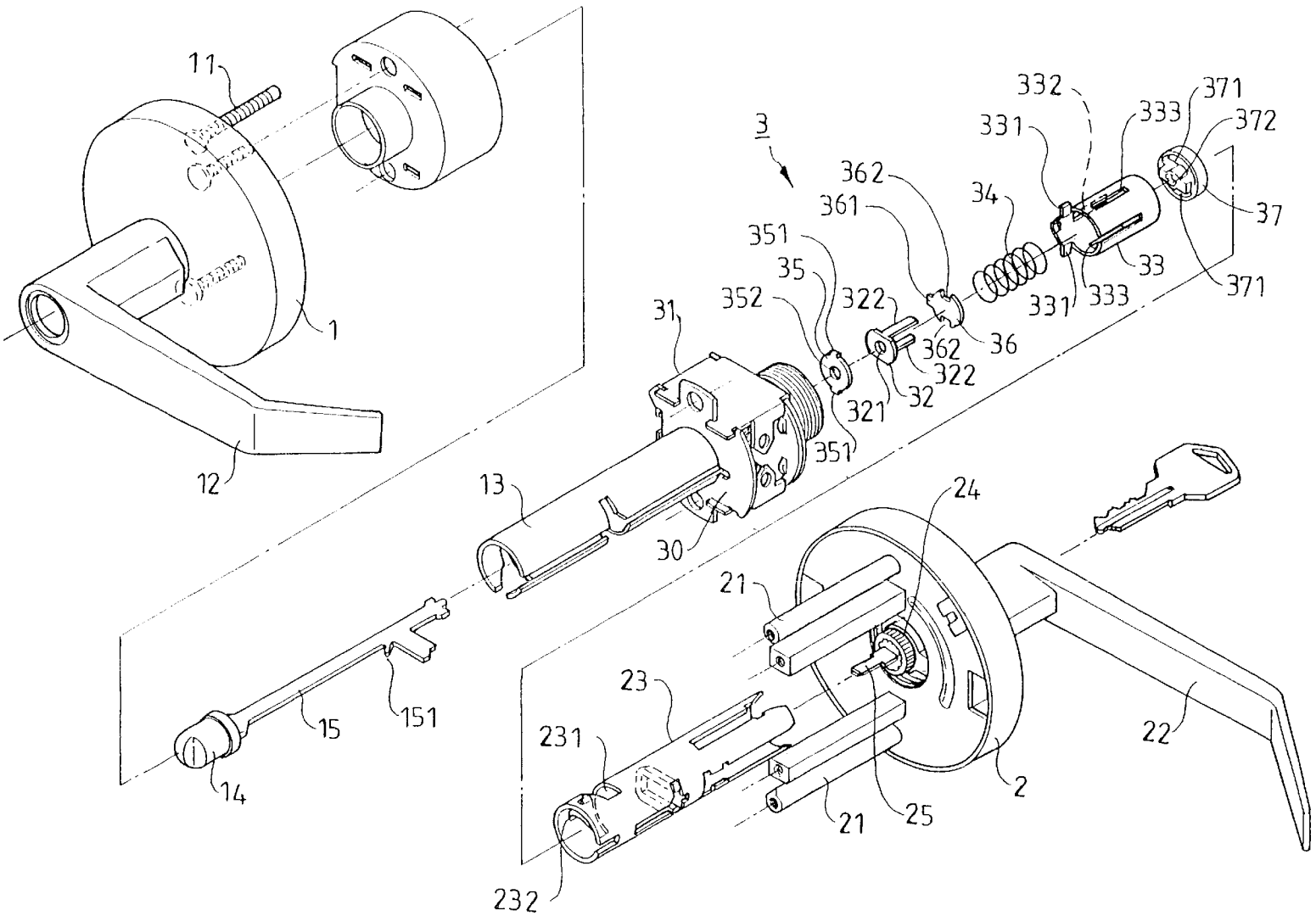
FIG. 1 is an exploded perspective view of an outer handle structure of a lock which may be idle in accordance with the present invention.
Figure 2:
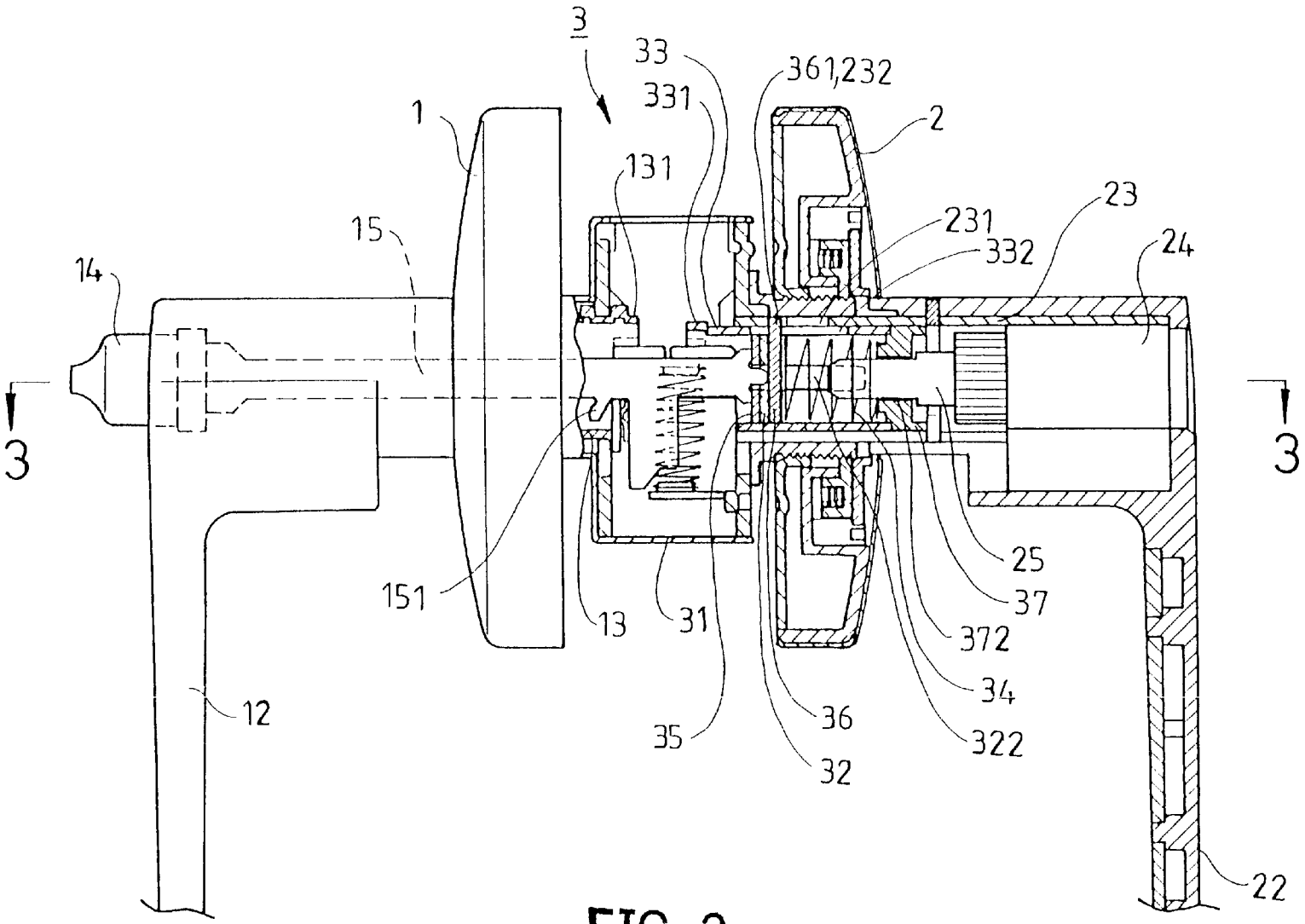
FIG. 2 is a top plan cross-sectional assembly view of the outer handle structure of a lock which may be idle as shown in FIG. 1, wherein the lock is unlocked.

Referring to the drawings and initially to FIGS. 1 and 2, an outer handle structure of a lock that may be idle in accordance with the present invention comprises an inner handle set 1, an outer handle set 2, and a latch release set 3.

The inner handle set 1 is fixed on the inner side of the door, and includes positioning members 11 which are combined with tubes 21 of the outer handle set 2. The inner handle set 1 is provided with an inner handle 12 which may be pressed, and rotated. The inner handle 12 may form various shapes, and is not limited to have a rod shape as shown in the figures. The inner handle 12 may drive an inner drive shaft 13 to rotate, and the inner drive shaft 13 drives the retractor 31 of the latch release set 3 to operate, for drawing a lock tongue of a lock latch to retract inward, which are conventional and will not be shown in the figures. The inner drive shaft 13 is provided therein with a press button 14 which is combined with one end of a safety bar 15, and the other end of the safety bar 15 is extended into the latch release set 3 to push a limit plate 35 and a lock snap plate 32 to move. The safety bar 15 is provided with a hook 151 which may be locked on a slot wall 30 of the latch release set 3, thereby forming a locking action.

The outer handle set 2 is fixed on the outer side of the door, and includes tubes 21 which are combined with positioning members 11, so that the inner handle set 1 and the outer handle set 2 are fixed in place. The outer handle set 2 is provided with an outer handle 22 which may be rotated. The outer handle 22 may form various shapes, and is not limited to have a rod shape as shown in the figures. The outer handle 22 may drive an outer drive shaft 23 to rotate. The outer handle set 2 is provided with a lock core set 24 which may be driven by a correct key to rotate a drive plate 25, so that the inner shaft barrel 33 may be rotated, the unlock the lock. The outer drive shaft 23 has one end combined with the outer handle 22, and driven by the outer handle 22 to rotate. The other end of the outer drive shaft 23 is extended into the latch release set 3. The outer drive shaft 23 receives an inner shaft barrel 33 therein. The outer drive shaft 23 defines a T-shaped slot including an annular slot 231 and a straight slot 232. When the follower block 361 of the follower plate 36 passes through the straight slot 332 of the inner shaft barrel 33 to be locked in the straight slot 232, the outer drive shaft 23 may drive the inner shaft barrel 33 to rotate. When the follower block 361 is locked in the annular slot 231, the outer drive shaft 23 may only idle relative to the follower plate 36 and the inner shaft barrel 33.

The latch release set 3 includes a retractor 31, a lock snap plate 32, an inner shaft barrel 33, an elastic member 34, a limit plate 35, a follower plate 36, and a lock snap disk 37.

The latch release set 3 has two ends respectively pivoted with the inner drive shaft 13 of the inner handle set 1 and the outer drive shaft 23 of the outer handle set 2. The drawing lock tongue mechanism in the retractor 31 of the latch release set 3 may be pressed by the wing plate 131 the inner drive shaft 13 (see FIG. 2), or pressed by the wing plate 331 of the inner shaft barrel 33, so that the retractor 31 retracts inward, so as to draw the lock tongue of the lock latch to retract inward, thereby unlock the door, which is a conventional structure of the lock, and will not be further described in detail. The latch release set 3 has a slot wall 30 forming slots, which may be hooked by the hook 151 of the safety bar 15.

Figure 5:
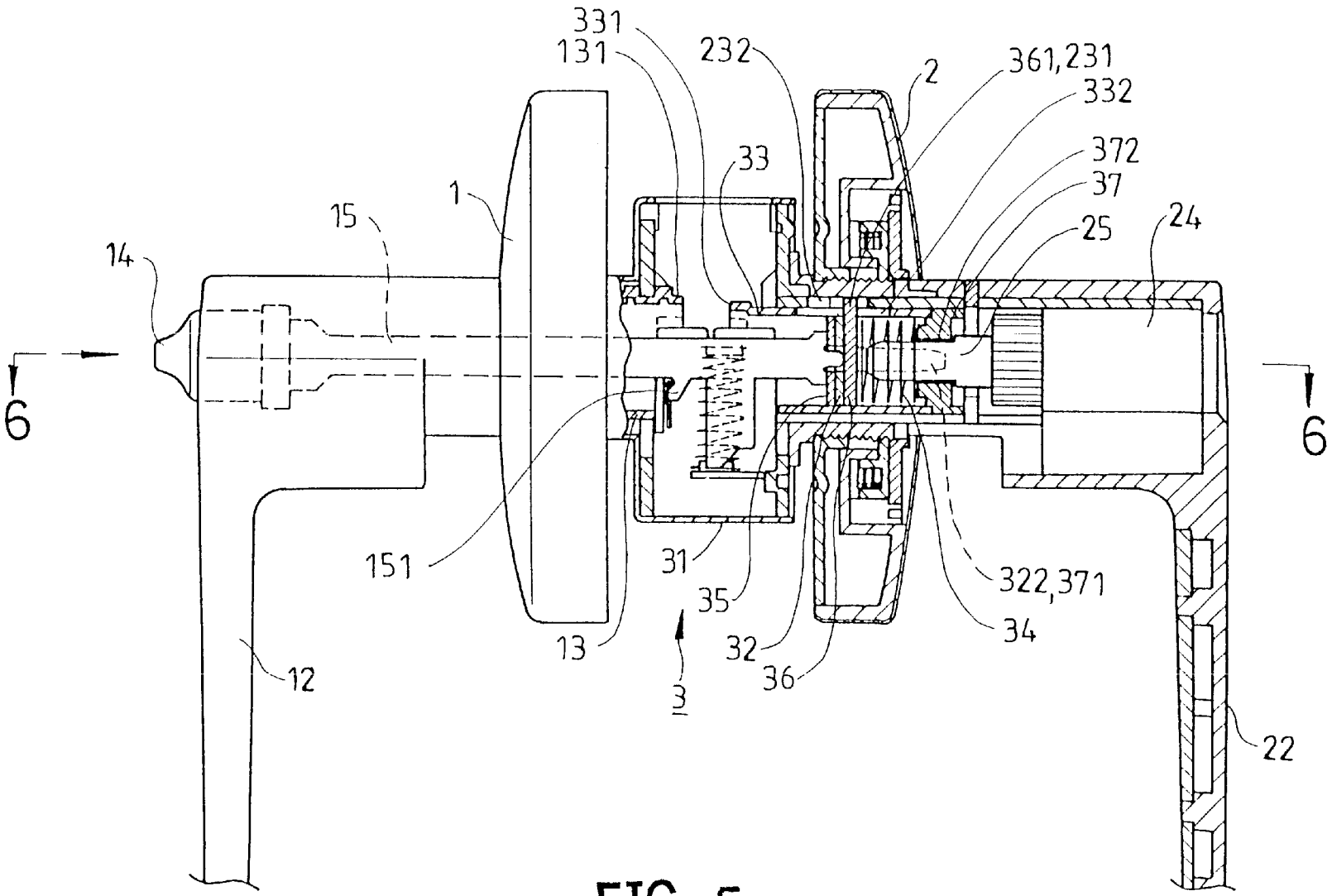
FIG. 5 is a top plan cross-sectional assembly view of the outer handle structure of a lock which may be idle as shown in FIG. 1, wherein the lock is locked.

The lock snap plate 32 and an elastic member 34 are placed in the inner shaft barrel 33, and are prevented from being detached from the inner shaft barrel 33 by a limit plate 35. The lock snap plate 32 has a central hole 321 urged by one end of the safety bar 15, and the lock snap plate 32 is provided with two locking legs 322. When the safety bar 15 is pressed toward the latch release set 3, the two locking legs 322 of the lock snap plate 32 may be locked in the two locking holes 371 of the lock snap disk 37 as shown in FIG. 5. The two locking legs 322 of the lock snap plate 32 passes the depressions 362 of the follower plate 36.

The inner shaft barrel 33 has two wing plates 331 that may press the retractor 31 of the latch release set 3 so as to draw the lock tongue of the lock latch to retract inward, thereby unlock the door. The inner shaft barrel 33 is received in the outer drive shaft 23, and the inner shaft barrel 33 receives therein an elastic member 34, a follower plate 36, and a lock snap plate 32 which are prevented from being detached from the inner shaft barrel 33 by the limit plate 35. The inner shaft barrel 33 defines a straight slot 332 therein, for allowing passage of the follower block 361 of the follower plate 36, so that the follower plate 36 may move linearly relative to the inner shaft barrel 33. The inner shaft barrel 33 defines guide slots 333 for receiving the lugs 351 of the limit plate 35 to lock therein, thereby guiding the limit plate 35 to move linearly relative to the inner shaft barrel 33.

The elastic member 34 is placed in the inner shaft barrel 33, for pressing the follower plate 36 and the lock snap plate 32, thereby keeping the two locking legs 322 of the lock snap plate 32 to detach from the two locking holes 371 of the lock snap disk 37, while the follower block 361 of the follower plate 36 is locked in the straight slot 232 of the outer shaft barrel 23.

The limit plate 35 includes two lugs 351 locked in the guide slots 333 of the inner shaft barrel 33, thereby preventing the elastic member 34, the follower plate 36, and the lock snap plate 32 from being detached from the inner shaft barrel 33. The limit plate 35 has a central hole 352 rested by one end of the safety bar 15.

The follower plate 36 is placed in the inner shaft barrel 33, and is provided with a follower block 361 which protrudes outward from a straight slot 332 defined in the inner shaft barrel 33, and may be locked in the annular slot 231 or the straight slot 232 of the outer drive shaft 23. The follower plate 36 additionally defines two depressions 362 for allowing passage of the two locking legs 322 of the lock snap plate 32.

The lock snap disk 37 is placed in the outer drive shaft 23, and may be rotated relative to the outer drive shaft 23. The lock snap disk 37 defines a sector-shaped hole 372 for allowing passage of a drive plate 25 of a lock core set 24 to pivot. The lock snap disk 37 defines two locking holes 371 whereby the two locking legs 322 of the lock snap plate 32 may be locked in or detached from the locking holes 371 of the lock snap plate 37.

Figure 3:
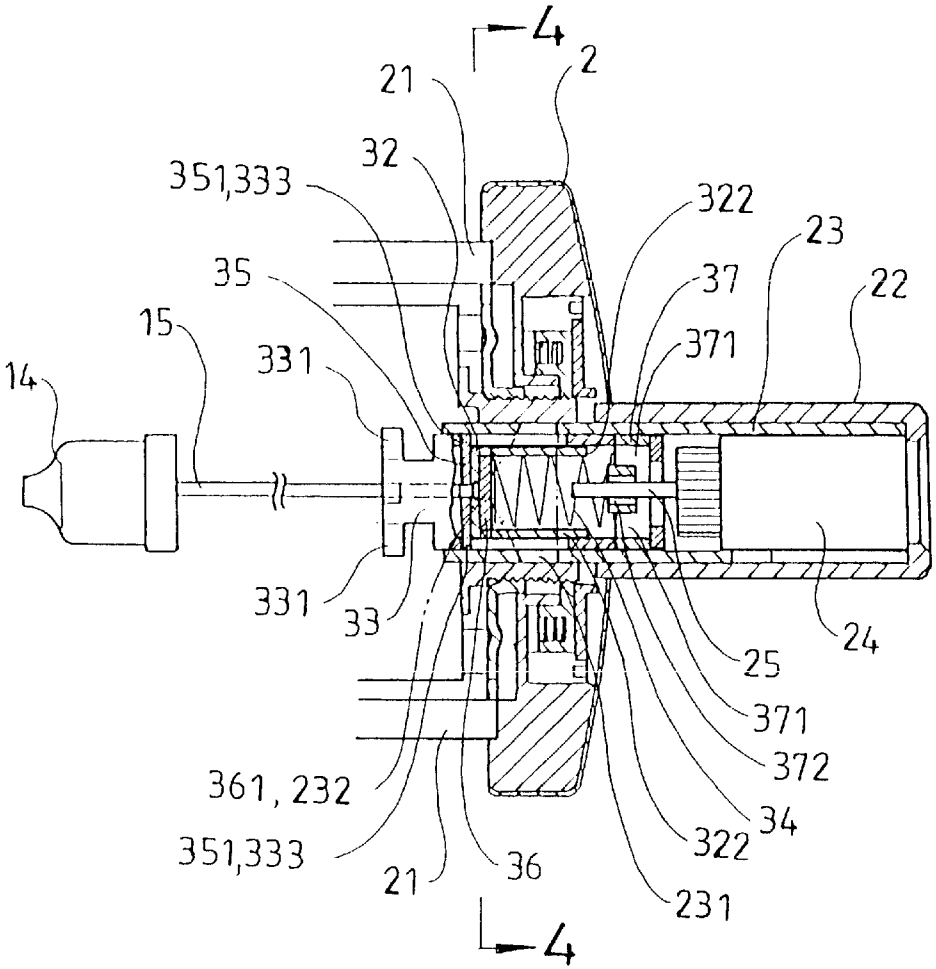
FIG. 3 is a cross-sectional view of the outer handle structure of a lock which may be idle along the line 3—3 as shown in FIG. 2.
Figure 4:
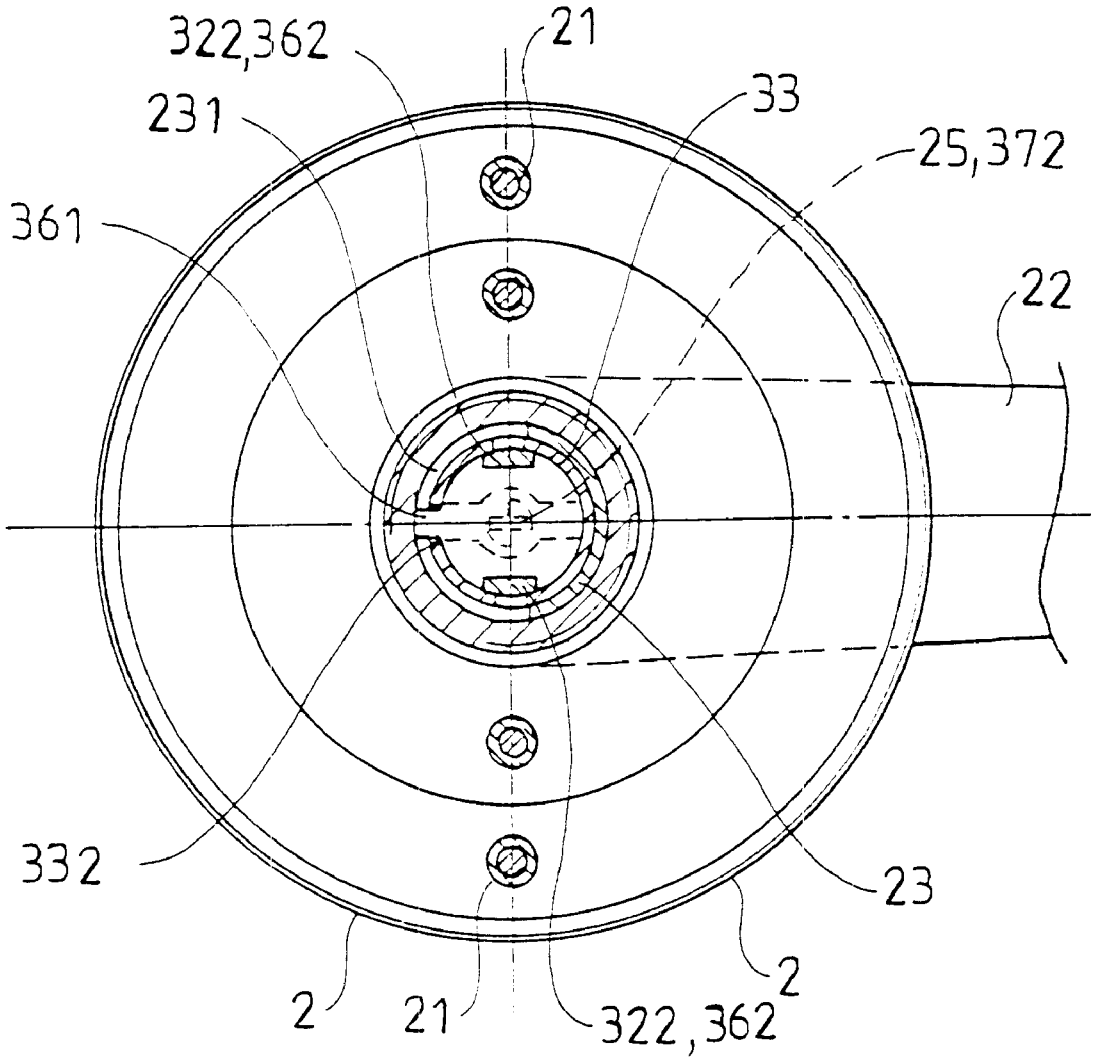
FIG. 4 is a cross-sectional view of the outer handle structure of a lock which may be idle along the line 4—4 as shown in FIG. 3.

Referring to FIGS. 2–4, the outer handle structure of a lock that may be idle in accordance with the present invention is assemble and is unlocked. The follower plate 36 is pressed by the elastic member 34, so that the follower block 361 of the follower plate 36 enters the straight slot 232 of the outer drive shaft 23. Therefore, by pressing the outer handle 22, the outer drive shaft 23 drives the follower plate 36 to rotate the inner shaft barrel 33. Thus, when the inner shaft barrel 33 is rotated, the wing plate 331 may press the retractor 31 to operate.

Figure 6:
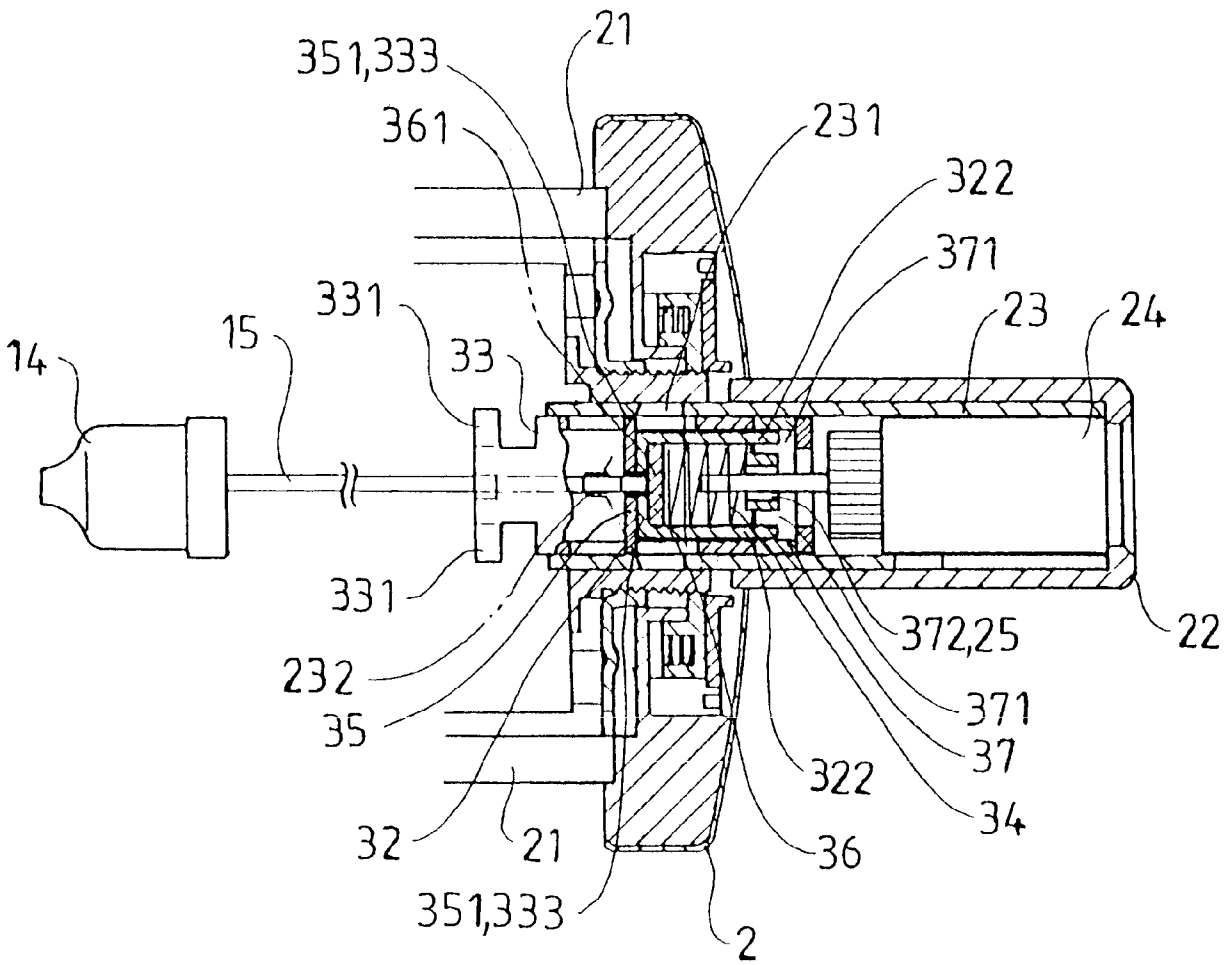
FIG. 6 is a cross-sectional view of the outer handle structure of a lock which may be idle along the line 6—6 as shown in FIG. 5.

Referring to FIGS. 5 and 6, the outer handle structure of a lock that may be idle in accordance with the present invention is locked. The press button 14 of the inner handle set 1 is pressed, whereby the safety bar 15 presses the limit plate 35 and the lock snap plate 32. Meanwhile, the follower block 361 of the follower plate 36 enters the annular slot 231 of the outer drive shaft 23, while the two locking legs 322 of the lock snap plate 32 are locked in the locking holes 371 of the lock snap plate 37, thereby locking the lock. Thus, rotation of the outer handle 22 will rotate the outer drive shaft 23, but the follower block 361 of the follower plate 36 is received in the annular slot 231 of the outer drive shaft 23, so that the outer drive shaft 23 cannot rotate the follower plate 36, and therefore cannot rotate the inner shaft barrel 33, such that the retractor 31 of the latch release set 3 cannot operate to draw the lock tongue of the lock latch to retract inward, and such that the door cannot be opened. Thus, the outer handle 22 idles in a predetermined angle.

Figure 7:
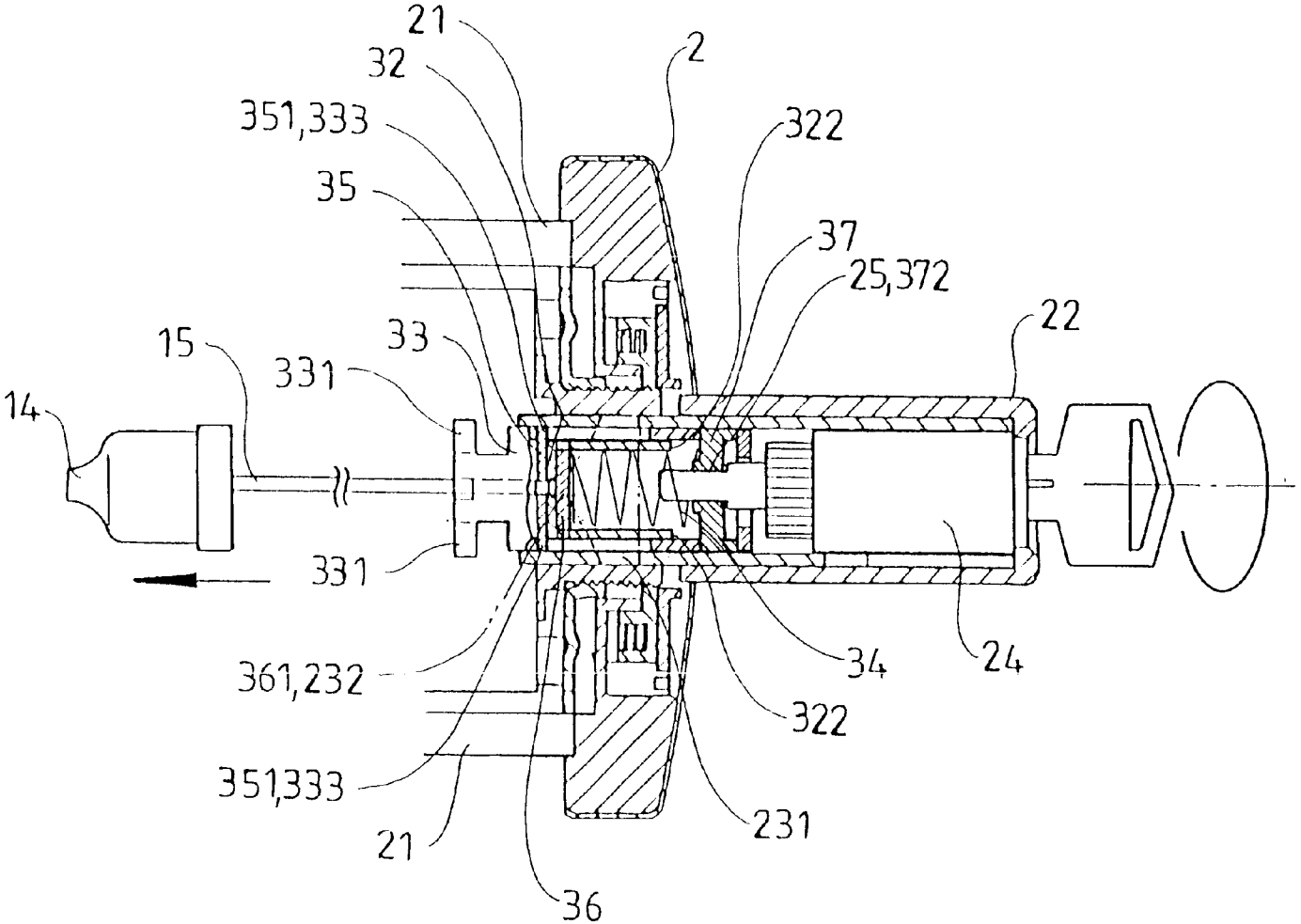
FIG. 7 is a schematic operational view of the outer handle structure of a lock which may be idle as shown in FIG. 6.

Referring to FIG. 7, when the locked lock core set 24 is desired to be unlocked from outside of the door, a correct key is inserted into the lock core set 24, to rotate the drive plate 25 which rotates the lock snap disk 37, which drives the locking legs 322 in the locking holes 371 to drive the lock snap plate 32. Meanwhile, the two locking legs 322 of the lock snap plate 32 passes through the depressions 362 of the follower plate 36, so that the follower plate 36 can also be rotated to rotate the inner shaft barrel 33 whose wing plates presses the retractor 31 of the latch release set 3 to operate, thereby unlocking the lock. That is, the press button 14 and the safety bar 15 may be returned to their original positions, so that the elastic member 34 will press the follower plate 36 and the lock snap plate 32 to return to their original positions. That is, the follower block 361 of the follower plate 36 again enters the straight slot 232 of the outer drive shaft 23, so that rotation of the outer handle 22 will drive the retractor 31 of the latch release set 3 to operate, thereby opening the door.

Accordingly, when the lock is locked from the inner side of the door, the outer handle outside of the door may form an idle rotation to be pressed. Thus, the entire lock will not be subjected to a strong press of the outer handle, to achieve the purpose of strongly pressing for unlocking the lock. In addition, the lock has a simple construction, thereby facilitating the assembly, and decreasing the cost of fabrication.

Although the invention has been explained in relation to its preferred embodiment as mentioned above, it is to be understood that many other possible modifications and variations can be made without departing from the scope of the present invention. It is, therefore, contemplated that the appended claim(s) will cover such modifications and variations that fall within the true scope of the invention.

What is claimed is:

1. An outer handle structure of a lock that may be idle, comprising:

an inner handle set, provided with an inner handle for driving an inner drive shaft to rotate, the inner drive shaft driving a retractor to operate and provided with a press button, to drive a safety bar to push a limit plate and a lock snap plate;

an outer handle set provided with an outer handle for driving an outer drive shaft to rotate, the outer drive shaft defining an annular slot and a straight slot arranged in a T-shape;

a latch release set provided with the retractor for drawing a lock tongue of a lock latch to operate, having two ends respectively pivoted with the inner drive shaft of the inner handle set and the outer drive shaft of the outer handle set, the outer drive shaft receiving an inner shaft barrel and a lock snap disk therein, the inner shaft barrel receiving an elastic member, a follower plate, and the lock snap plate therein which are prevented from being detached from the inner shaft barrel by the limit plate having lugs, the lugs of the limit plate being confined within guide slots provided on the inner shaft barrel; and the follower plate provided with a follower block which protrudes outwards from a straight slot defined in the inner shaft barrel, and may be locked in the annular slot or the straight slot of the outer drive shaft, the follower plate defining two depressions for allowing passage of two locking legs of the lock snap plate, the two locking legs of the lock snap plate may be locked in or detached from two locking holes of the lock snap disk, the inner shaft barrel having wing plates that may press the retractor.

2. The outer handle structure of a lock which may be idle as claimed in claim 1, wherein the lock snap disk defines a sector-shaped hole for allowing passage of a drive plate of a lock core set to pivot.

* * * * *